United States Patent [19]

Murayama

[11] Patent Number: 4,517,417

[45] Date of Patent: May 14, 1985

[54] COMMUNICATION SYSTEM FOR A MOTOR VEHICLE

[75] Inventor: Masato Murayama, Kawagoe, Japan

[73] Assignee: Honda Giken Kogyo Kabushiki Kaisha, Tokyo, Japan

[21] Appl. No.: 477,926

[22] Filed: Mar. 23, 1983

[30] Foreign Application Priority Data

| | | | |
|---|---|---|---|
| Mar. 25, 1982 | [JP] | Japan | 57-042176[U] |
| Mar. 25, 1982 | [JP] | Japan | 57-042177[U] |
| Mar. 25, 1982 | [JP] | Japan | 57-042178[U] |
| Mar. 25, 1982 | [JP] | Japan | 57-042179[U] |
| May 12, 1982 | [JP] | Japan | 57-069336[U] |

[51] Int. Cl.[3] ..... H04R 1/08; H04R 1/28

[52] U.S. Cl. ..... 179/156 R; 381/86; 381/91; 179/187; 179/107 FD

[58] Field of Search ..... 179/156 A, 156 R, 146 R, 179/157, 146 E, 187, 188, 184, 178, 180, 81 B, 121 R, 107 R, 107 FD; 381/86, 91, 92, 122

[56] References Cited

U.S. PATENT DOCUMENTS 3,786,519 1/1974 Aileo ..... 179/156 A X

FOREIGN PATENT DOCUMENTS 340273 12/1930 United Kingdom ..... 179/156 A

OTHER PUBLICATIONS

Hatcom ® publication, 1979.

*Primary Examiner*—Gene Z. Rubinson
*Assistant Examiner*—James L. Dwyer
*Attorney, Agent, or Firm*—Birch, Stewart, Kolasch & Birch

[57] ABSTRACT

A microphone unit for mounting in a protective headwear including a housing member for housing the microphone unit and a sound introducing passage forming an aperture in the housing member for introducing a sound pressure into the microphone unit. The sound introducing passage includes a configuration wherein an area of the aperture thereof increases as the distance increases away from a sound collecting surface of the microphone unit. A communication passage is formed in the housing member which provides communication between a surface of the microphone unit other than the sound collecting surface and the exterior of the housing member. The housing for the microphone unit is mounted at a position displaced a predetermined distance away from a central axis of said protective headwear. The microphone unit selectively receives audible sounds generated by a user of the protective headwear. Sound tubes are connected to the speaker case and positioned along an inner surface of the protective headwear. The sound tubes are for transmitting a sound from said speaker unit to an ear of a user of the protective headwear. An audio signal control system is provided for transmitting an audio signal from a signal source including a microphone for sensing a sound from outside. A detector means is provided for detecting when the level of a frequency component of sound sensed by said microphone exceeds a predetermined reference level for a time period longer than a predetermined interval and for producing a detection signal. A control means is provided for stopping a transmission of at least one frequency component of said audio signal corresponding to said frequency component of sound upon presence of said detection signal.

2 Claims, 10 Drawing Figures

COMMUNICATION SYSTEM FOR A MOTOR VEHICLE

BACKGROUND OF THE INVENTION

1. Field of the Invention

The present invention relates to a communication system for a motor vehicle, and more particularly to improvements in a communication system including microphone and speaker units mounted in a protective headwear.

2. Description of Background Information

In communication systems for a motor vehicle such as a motorcycle, there is a type of headset including a microphone and speaker units mounted in a full face type protective headwear. However, in such an arrangement there are several drawbacks relating to the speech sending and receiving performance. Specifically, since the microphone is disposed in the proximity of the speaker in the protective headwear, it was difficult to prevent howling and acoustic feedback between the microphone and the speaker in this arrangement. In addition to this problem, the microphone of this arrangement was subjected to noise caused by the breathing of the operator or other noises.

As for the speaker units of this arrangement, a problem existed in that a complex construction process is necessary to mount the speaker units inside the protective headwear causing a considerable increase in the cost of the protective headwear. Furthermore, since the ears of the operator are covered by the speaker units and the body of the protective headwear, it was usually not easy for the operator to listen to a sound from outside such as a siren of an ambulance car. Moreover, in the prior art audio circuit for this kind of communication system, there was no provision of means for helping the operator to listen to the sound from the outside.

SUMMARY OF THE INVENTION

An object of the present invention is therefore to provide a communication system for a motor vehicle, which is free from the above drawbacks of the prior art communication systems.

According to the present invention, the microphone mounted in the protective headwear is offset from a centerline of the protective headwear to reduce the detection of the breathing of an individual using the protective headwear.

Another object of the present invention is to position the microphone within a housing including a sound introducing passage and a communication passage for eliminating acoustic feedback between the speakers and the microphone.

A further object of the present invention is to provide a housing for the microphone wherein the area of aperture of the sound introducing passage gradually increases in area as the distance increases away from a sound collecting surface of the microphone.

A further object of the present invention is to provide speakers in a protective headwear which are displaced rearwardly with respect to the ears of an individual using the protective headwear.

Another object of the present invention is to provide sound tubes constructed of plastic material for mounting on a protective headwear to extend inwardly to a position adjacent to the ears of an individual using the protective headwear.

A still further object of the present invention is to provide an electrical circuit for the speakers of a protective headwear which is responsive to a predetermined sound frequency for more than a predetermined time to reduce or terminate the signal applied to the speakers.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
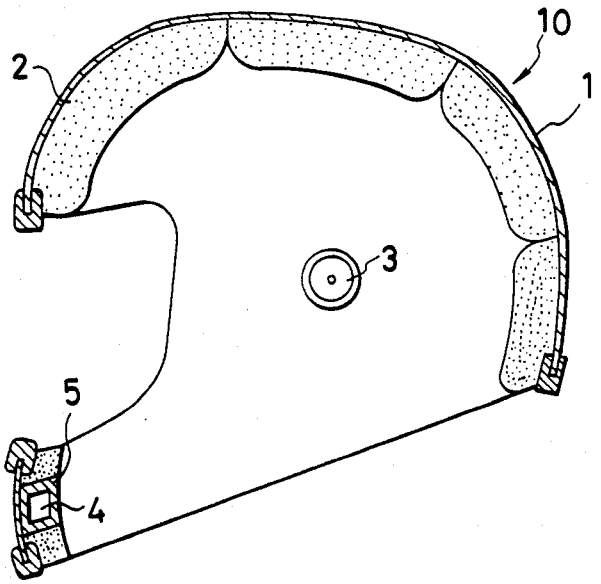
FIG. 1 is a sectional view of a protective headwear which is equipped with a microphone according to the present invention.
Figure 2:
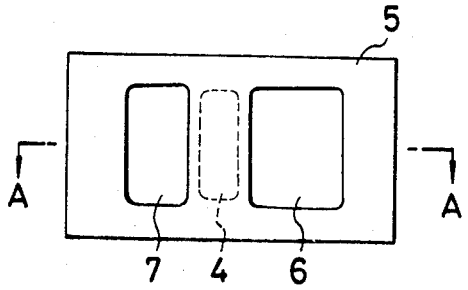
FIG. 2 is a front view of the microphone.
Figure 3:
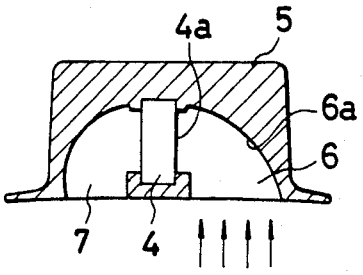
FIG. 3 is a section taken along line A—A of FIG. 2.

Reference is first made to FIGS. 1 to 3 in which an embodiment of the microphone according to the present invention is illustrated. In FIG. 1, a protective headwear generally designated by 10 includes a body 1 of a hard plastic material and a buffer layer 2 of a constant thickness made of a sponge material. A pair of speakers 3 are mounted inside of the body 1 at a position facing to the ear of an operator. A microphone 4 which constitutes a part of a transmitting and receiving system is also disposed in the body 1. The microphone 4 is housed in a housing member 5 and received in a recess formed at a portion of the buffer layer 2 which faces to the mouth of the operator.

As shown in FIG. 3, the microphone 4 is directed in the housing member 5 in such a manner that a sound collecting surface 4*a* thereof is substantially perpendicular to the front face of the housing member 5. The housing member 5 is provided with a sound introducing passage 6 for introducing a sound pressure to the sound collecting surface 4*a* of the microphone 4, and a communication passage 7 which provides a communication between a back face of the microphone 4 and the outside space of the housing member 5. The back face of the microphone 4 locates oppositely to the sound collecting surface 42. Both the sound introducing passage 6 and the communication passage 7 open at the front face of the housing member 5 as shown in FIG. 2 so that the passages 6 and 7 can communicate with the space inside of the protective headwear. By the arrangement of the sound introducing passage 6 and the communication passage 7 the acoustic feedback between the speakers 3 and the microphone 4, which might occur in the prior art, can be eliminated. Furthermore, the sound introducing passage 6 has a configuration wherein a curved surface is formed at a portion facing to the sound collecting surface 4*a* of the microphone 4 and the area of aperture thereof gradually increases as the distance increases away from the sound collecting surface 4*a*.

When the sound pressure of the speech of the operator arrives at the front face of the housing member 5 as shown by arrows in FIG. 3, the sound pressure is smoothly guided to the sound collecting surface 4*a* of the microphone by means of the curved surface of the sound introducing passage 6. Furthermore, there is an advantage in that the sound pressure is increased at the sound collecting surface 4*a* by means of the configuration of the gradually increasing area of the aperture of the sound introducing passage 6. In this way, the sensitivity of the microphone 4 to the speech of the operator is much increased as compared with a conventional arrangement in which the sound collecting surface of the microphone is substantially parallel to a surface facing thereto.

On the contrary, the sound pressure from the speaker unit 3 reaching the sound collection surface 4*a* is not increased as the sound passes through the sound introducing passage 6. Therefore, the signal to noise ratio or the anti-howling characteristics can be improved by reducing the gain of an amplifier for amplifying an output signal of the microphone.

Figure 4:
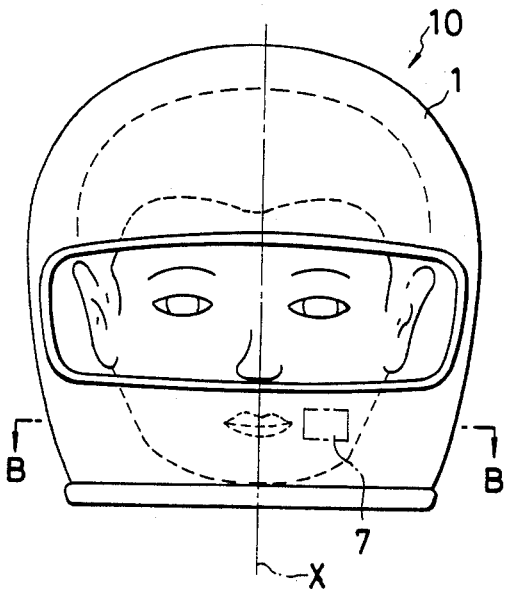
FIG. 4 is a front view of a protective headwear illustrating an arrangement of a microphone in accordance with the present invention.
Figure 5:
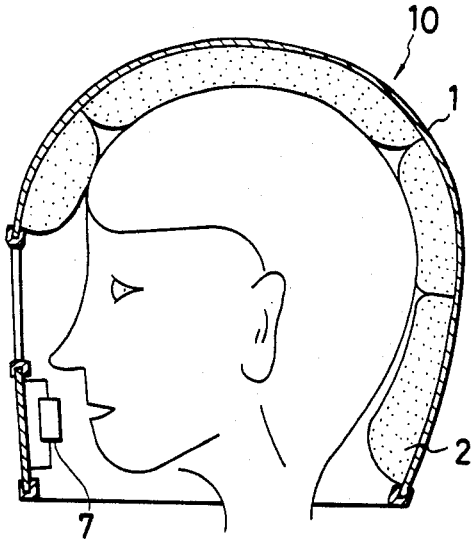
FIG. 5 is a vertical section of FIG. 4.
Figure 6:
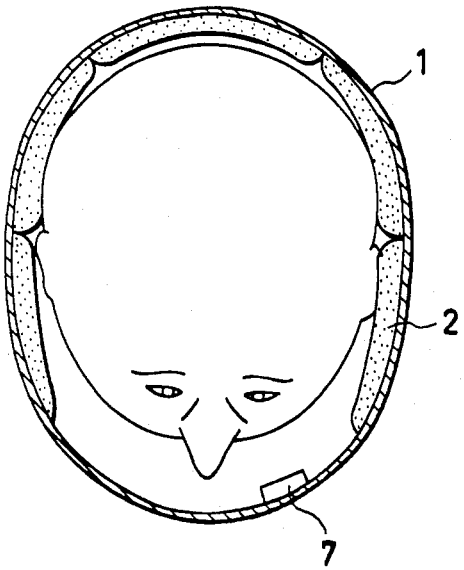
FIG. 6 is a horizontal section taken along line B—B of FIG. 4.

Reference is now made to FIGS. 4 through 6, an improvement of the position of the microphone according to the present invention will be explained. As shown in FIGS. 4 through 6, the improvement features a microphone unit 7 disposed at a position in the protective headwear which is displaced away from the central axis X of the protective headwear 10. By this arrangement, the microphone unit 7 picks up only the sound pressure of the speech of the operator and can eliminate the sound pressure cause by the breathing of the operator.

Figure 7:
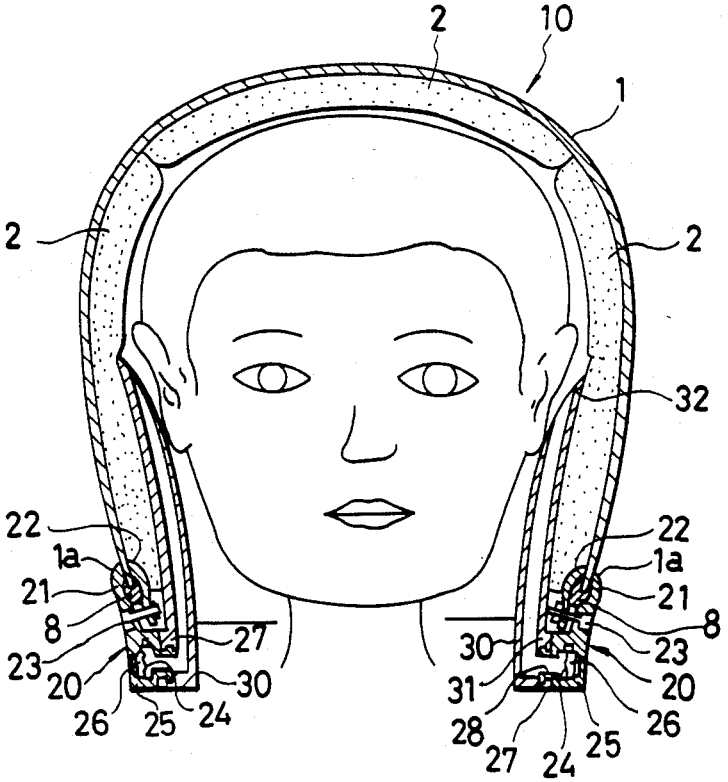
FIG. 7 is a sectional view of a protective headwear equipped with speaker units according to the present invention.

Referring to FIG. 7, a speaker assembly according to the present invention will be explained. As shown, the lower end portion 1*a* of the body 1 of the protective headwear is covered by a flange member 8. The speaker assemblies generally designated by 20 are fixed to the flange member 8 by means of fixing portions 21 and 22 and a bolt provided at an end of a speaker case 25. The speaker case 25 includes a chamber 24 for housing a speaker unit 26 and a communication passage 28 and a flange portion 27 formed around the outer periphery of an opening of communication passage 28.

A sound tube 30 made of a soft plastic material or rubber is connected to the speaker case 25 by an engagement between a connecting end 31 thereof and the flange portion 27 of the speaker case 25. The sound tube 30 is held substantially upright along the inner wall of the buffer member 2. The length of the sound tube is so determined that an open end 32 thereof is positioned at the height of the ear of the operator. This open end 32 is cut obliquely so that the opening of the sound tube 30 faces to the ear of the operator. Furthermore, the sound tube 30 is slightly outwardly curved so as to be pressed against the inner wall of the buffer material 2 and securely held in the protective headwear 10. In addition, this provision of a curved sound tube will ensure an easy wearing of the protective headwear 10.

Figure 8:
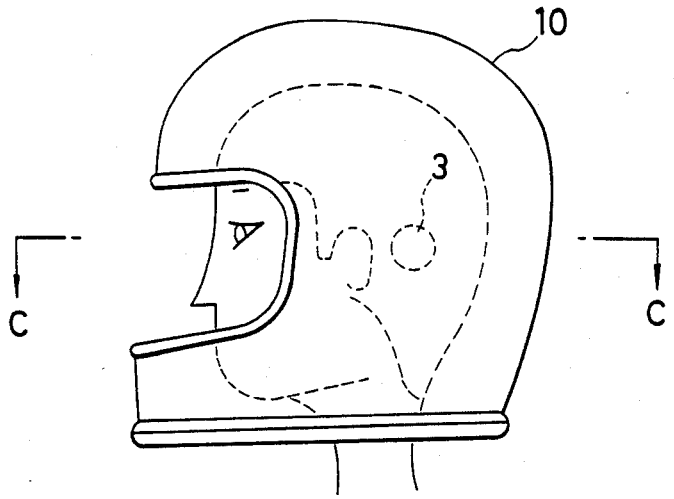
FIG. 8 is a side view of a protective headwear showing an arrangement of speaker units in accordance with the present invention.
Figure 9:
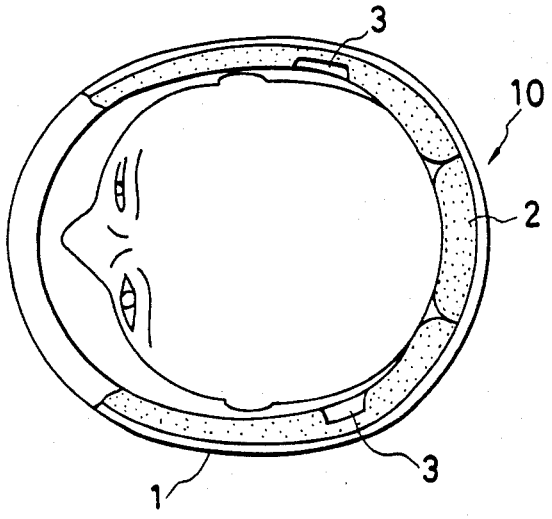
FIG. 9 is a horizontal section taken along line C—C of FIG. 8.

Reference is now made to FIGS. 8 and 9 in which an arrangement of speaker units in the protective headwear according to the present invention is illustrated. This arrangement illustrates the speaker units 3 being disposed at a position just behind the ears of the operator. By this arrangement of the speaker units 3 the operator can readily listen to the sound from outside without deteriorating the sound from the speakers 3.

Figure 10:
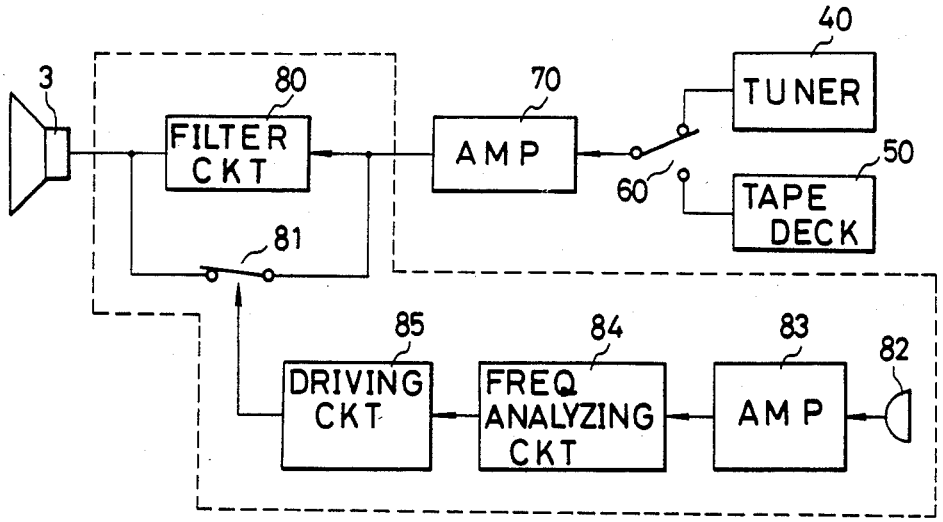
FIG. 10 is a block diagram of an audio circuit according to the present invention.

Referring to FIG. 10, an audio circuit according to the present invention will be explained. In FIG. 10, audio output signals from a tuner unit 40 and a tape deck unit 50 are applied to a selector switch 60. An output signal of the selector switch 60 is then applied to an audio amplifier 70 which produces a power output signal for driving a speaker unit 3. Between the audio amplifier 70 and the speaker unit 3 there is provided a parallel circuit of a filter circuit 80 for cutting a predetermined frequency component of an input signal and a normally closed switch 81 which is controlled by a control circuit described hereafter.

The control circuit includes a microphone 82 for collecting the sound from outside. An output signal of the microphone 82 is applied to a frequency analyzing circuit 84 via an amplifier 83. The frequency analyzing circuit 84 includes a filter, a comparator, and a timer circuit and produces a detection signal when the level of a component of an input signal within a specific frequencial range exceeds a predetermined reference level for more than a predetermined time period. The detection signal from the frequency analyzing ciruit is then applied to a driving circuit 85 which produces a drive signal for opening the control switch 81 upon receiving the detection signal from the frequency analyzing circuit.

In this arrangement, the output signal of the amplifier 70 is usually directly applied to the speaker 3 via the closed contacts of the switch 81. When, on the other hand, an outside sound such as an alarm of an ambulance car is detected by the microphone 82 and the frequency analyzing circuit 84 produces the detection signal, the switch 81 is then opened by the drive signal of the driving circuit 85 and therefore the output signal of the amplifier 70 is applied to the speaker 3 via the filter circuit 80. In this state the operator can easily listen to the outside sound since the sound from the speaker is limited to the frequency passing through the filter circuit. Needless to say, the characteristics of the filter circuit 80 is preferably determined so that at least a frequency component corresponding to a predetermined outside sound such as a siren sound is eliminated as the audio signal passes through the filter circuit 80. Furthermore, it should be noted that the arrangement can be modified to omit the filter circuit 80 so that the signal from the amplifier 70 is completely disconnected when the switch 81 is opened by the control circuit.

It will be appreciated from the foregoing that a communication system having a provision for allowing an operator of a vehicle to listen to the outside sound, and having an improved anti-howling characteristics is provided according to the present invention.

It should be understood that the foregoing description is for illustrative purpose only, and is not intended to limit the scope of the invention. Rather, there are numerous equivalents to the preferred embodiments, and such are intedned to be covered by the appended claims.

What is claimed is:

1. A protective headwear having a microphone and a speaker mounted therein, wherein the protective headwear is of a full-face type comprising:

a speaker operatively positioned so that a sound producing part thereof is located behind the ear of a user of the protective headwear;

a microphone having a first sound collecting surface and a second portion positioned to be buried in a front lower part of the protective headwear, offset from a central plane of the protective headwear, and arranged so that said first sound collecting surface of microphone is perpendicular to a surface of an inner wall of said front lower part and positioned to be closer to the central plane than said second portion of the microphone;

said microphone including a housing member with a sound introducing passage leading from said sound collecting surface and opening in said inner wall, and an area of an aperture of the sound introducing passage increases as the distance increases away from the sound collecting surface.

2. A protective headwear according to claim 1, further comprising a communication passage formed in said housing member which provides communication between a surface of said microphone unit opposite to said sound collecting surface and the exterior of said housing member.

* * * * *